US010886709B1

(12) United States Patent
Abe et al.

(10) Patent No.: US 10,886,709 B1
(45) Date of Patent: Jan. 5, 2021

(54) SPARK PLUG THAT PREVENTS GAS TURBULENCE IN THE DISCHARGE SPACE

(71) Applicant: DENSO CORPORATION, Kariya (JP)

(72) Inventors: Yuya Abe, Kariya (JP); Masamichi Shibata, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 16/905,174

(22) Filed: Jun. 18, 2020

(30) Foreign Application Priority Data

Jun. 19, 2019 (JP) ..... 2019-113802

(51) Int. Cl.
*H01T 13/32* (2006.01)

(52) U.S. Cl.
CPC ..... *H01T 13/32* (2013.01)

(58) Field of Classification Search
CPC ..... H01T 13/20; H01T 13/39; H01T 13/32; H01T 21/06; C22C 5/04; C22C 19/05
See application file for complete search history.

(56) References Cited

U.S. PATENT DOCUMENTS

2013/0328476 A1 12/2013 Ban et al.
2016/0363082 A1* 12/2016 Malm ..... F02P 5/1502
2017/0107932 A1* 4/2017 Ochi ..... F02D 41/26
2019/0165548 A1* 5/2019 Kato ..... F01P 3/16

FOREIGN PATENT DOCUMENTS

JP 2017-147086 8/2017
JP 2019-125570 7/2019

OTHER PUBLICATIONS

Suzuki et al., "Study of Ignitability in Strong Flow Field", Ignition Systems for Gasoline Engines, 2017, pp. 69-84.

* cited by examiner

*Primary Examiner* — Tracie Y Green
(74) *Attorney, Agent, or Firm* — Nixon & Vanderhye P.C.

(57) ABSTRACT

On a base part forming a ground electrode in a spark plug, a facing surface is formed facing a distal end surface of a central electrode to have a shortest gap between the facing surface and the central electrode. A first slope surface is formed on an upper surface of the base part. A downstream-side end surface is formed parallel with a virtual plane, and connected to the first slope surface. A second slope surface is formed on a lower surface of the base part, connected to a downstream-side end surface. An opposing surface is formed on the lower surface of the base part. A width of the facing surface is wider than a width of the opposing surface. A first angle of the facing surface to the first slope surface satisfies a relationship of $10° \leq \theta 1 \leq 40°$.

10 Claims, 13 Drawing Sheets

SPARK PLUG THAT PREVENTS GAS TURBULENCE IN THE DISCHARGE SPACE

CROSS-REFERENCE TO RELATED APPLICATION

This application is related to and claims priority from Japanese Patent Application No. 2019-113802 filed on Jun. 19, 2019, the contents of which are hereby incorporated by reference.

TECHNICAL FIELD

The present disclosure relates to spark plugs.

BACKGROUND

A patent document 1, Japanese patent laid open publication No. 2017-147086 discloses a spark plug including a central electrode and a ground electrode. A fuel mixture gas flows along a direction which is perpendicular to a plate surface of the ground electrode having a curved structure. Such a fuel mixture gas flows from in a direction through a spark gap formed between the central electrode and the ground electrode. A projection part is formed on an upper surface side of the ground electrode at an upstream side in the flow direction of the fuel mixture gas. The projection part of the ground electrode has a slope structure in which a slope is formed from an upper side of the projection part at the left-hand side to a lower side at the right-hand side of the projection part. In more detail, the top of the projection part is arranged at an upstream side of the fuel mixture gas which is different in distance from a central axis of the central electrode in a direction perpendicular to the axial direction of the spark plug. This structure of the projection part makes it possible to generate a vortex flow of the fuel mixture gas at a spark gap formed between the central electrode and the ground electrode. When a predetermined voltage is applied between the central electrode and the ground electrode, a discharge spark is generated and a vortex flow of the fuel mixture gas is also generated. The generated vortex flow of the fuel mixture gas leads to an extension of the discharge spark.

However, gas turbulence easily occurs between the central electrode and the ground electrode in the structure of the spark plug disclosed in Patent document 1 previously described. This easily leads to a short circuit at a middle of the extended discharge spark. Accordingly, unstable discharge spark often occurs, and this reduces the ignitability of a fuel mixture gas composed of a fuel and air in the spark plug.

SUMMARY

It is desired for the present disclosure to provide a spark plug including a metal shell, a center electrode, a ground electrode. The metal shell has a cylindrical shape. The center electrode is disposed in an inside of the metal shell. The ground electrode is connected to the metal shell. The ground electrode has a curved shape and is arranged facing a distal end surface of the central electrode. In the ground electrode, a virtual plane parallel to the curved shape of the ground electrode faces a flow of a fuel mixture gas. The ground electrode has a base part. The base part of the ground electrode has a facing surface, a first slope surface, a downstream-side end surface, a second slope surface and an opposing surface. The facing surface is formed on an upper surface of the base part at a position facing the distal end surface of the central electrode to form a spark gap between the facing surface and the distal end surface of the central electrode. The first slope surface is formed on an upper surface of the base part and connected to the opposing surface, and increasingly away from the distal end surface of the central electrode in a flow direction of the fuel mixture gas. The downstream-side end surface is formed most downstream side in the flow direction of the fuel mixture gas and parallel with the virtual plane, and connected to the first slope surface. The second slope surface is formed on a lower surface of the base part and connected to the downstream-side end surface, approaching the distal end surface of the central electrode in the flow direction of the fuel mixture gas. The opposing surface is formed farthest away from the distal end surface of the central electrode. The base part of the ground electrode is formed so that a width of the facing surface of the base part is wider than a width of the opposing surface of the base part, and a first angle θ1 of the facing surface to the first slope surface satisfies a relationship of $10° \leq \theta 1 \leq 40°$, and a first distance L1 satisfies a relationship of $0.3\ \text{mm} \leq L1 \leq 0.9\ \text{mm}$, where the first distance is measured, along the central axis of the central electrode in which the central electrode is disposed into the metal shell, from a connection point between the second slope surface and the downstream-side end surface to the facing surface of the base part.

BRIEF DESCRIPTION OF THE DRAWINGS

A preferred, non-limiting embodiment of the present disclosure will be described by way of example with reference to the accompanying drawings, in which.

DETAILED DESCRIPTION OF THE PREFERRED EMBODIMENTS

Figure 1:
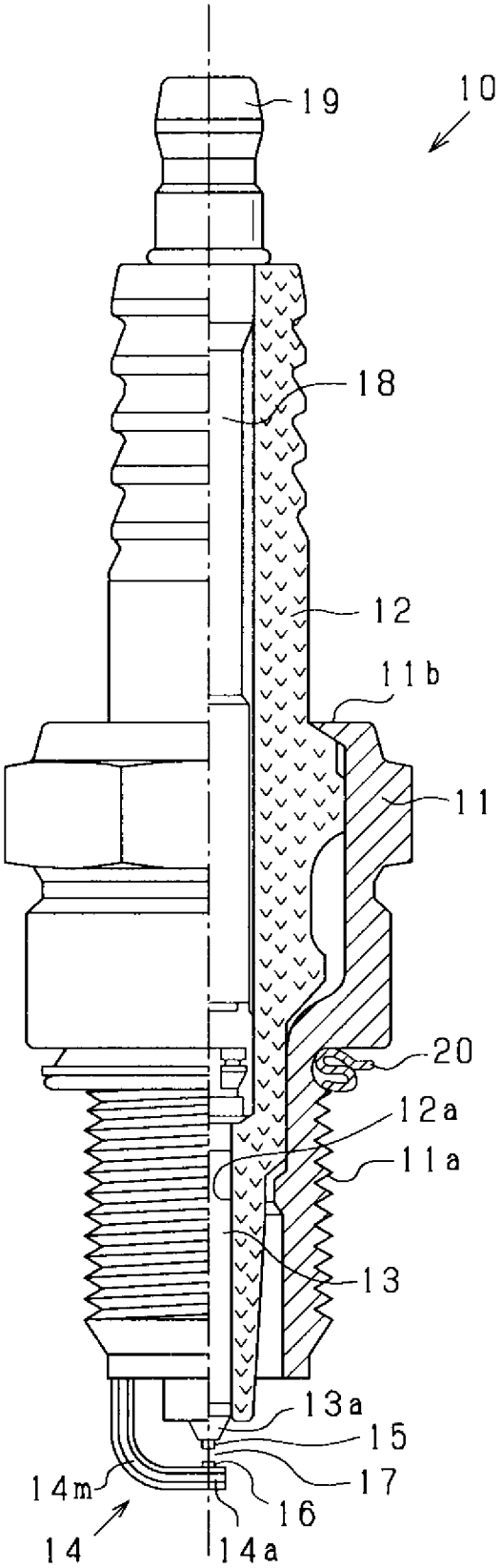
FIG. 1 is a view showing a cross section of a half part of a spark plug according to an exemplary embodiment of the present disclosure.

Hereinafter, various embodiments of the present disclosure will be described with reference to the accompanying drawings. In the following description of the various embodiments, like reference characters or numerals designate like or equivalent component parts throughout the several diagrams.

Exemplary Embodiment

A description will be given of a spark plug 10 according to an exemplary embodiment of the present disclosure with reference to FIG. 1 to FIG. 15.

FIG. 1 is a view showing a cross section of a half part of the spark plug 10 according to the exemplary embodiment of the present disclosure.

As shown in FIG. 1, the spark plug 10 has a metal shell 11 (or a housing) and an insulator 12. The metal shell 11 has a cylindrical shape, and the insulator 12 also has a cylindrical shape. A bottom end of the insulator 12 is disposed and coaxially arranged in the metal shell 11. The metal shell 11 is made of a metal member such as of iron. A screw part 11*a* is formed at the bottom end of the insulator 12. The metal shell 11 and the insulator 12 are assembled together by caulking an upper end 11*b* of the metal shell 11. A central electrode 13 is disposed into a through hole 12*a* formed in the bottom end of the insulator 12

The central electrode 13 has a cylindrical shape made of Ni alloy having a superior heat resistance. An inside part of the central electrode 13 is made of copper, and an outer skin part of the central electrode 13 is made of nickel based alloy. A distal end part 13*a* of the central electrode 13 is exposed from the bottom end of the insulator 12.

Figure 2:
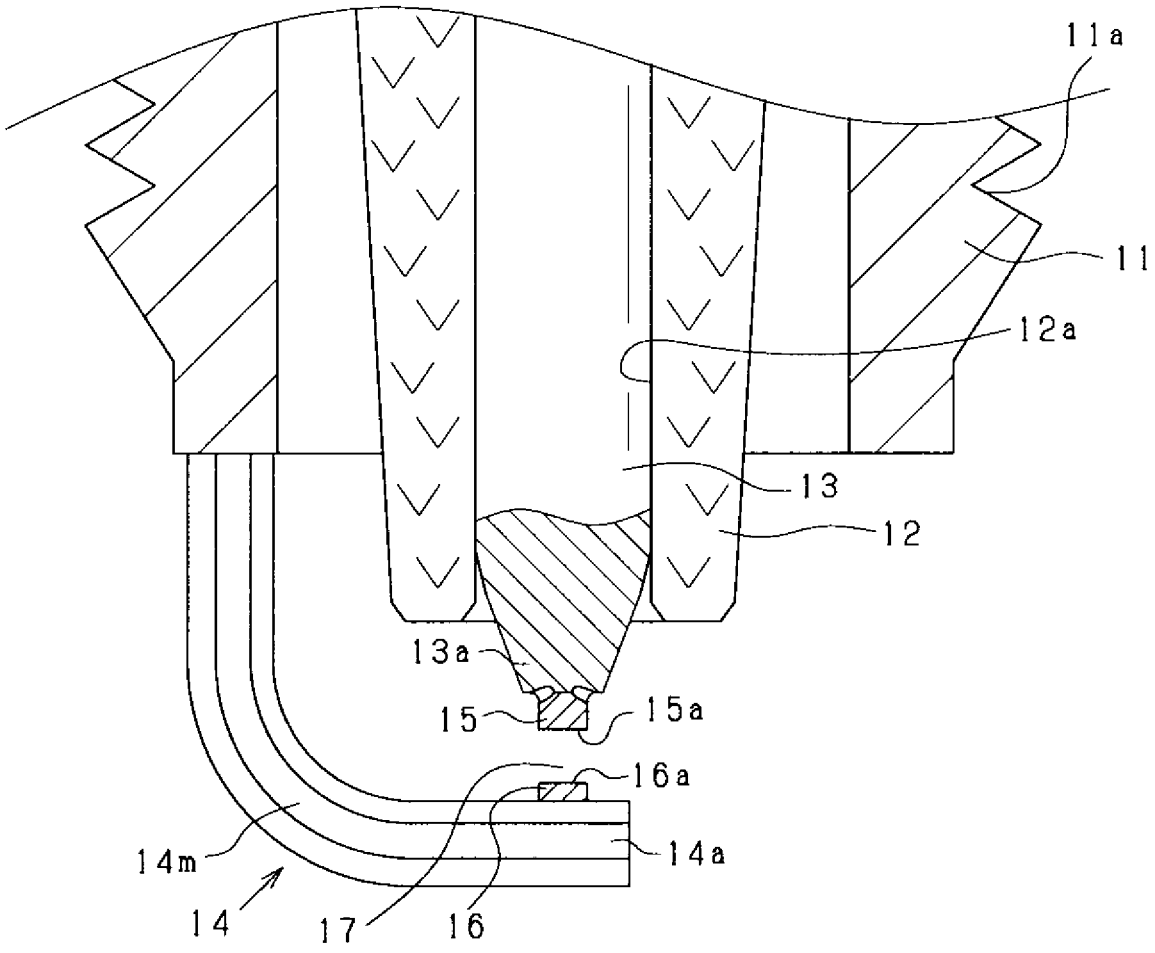
FIG. 2 is a view showing an enlarged cross section of part of the spark plug shown in FIG. 1.

FIG. 2 is a view showing an enlarged cross section of part of the spark plug 10 shown in FIG. 1. As shown in FIG. 1 and FIG. 2, a ground electrode 14 has a curved shape extending from the bottom end of the metal shell 11. That is, the ground electrode 14 is arranged at a position which faces the distal end part 13*a* of the central electrode 13.

The ground electrode 14 has a curved shape and is fixed to the metal shell 11 so that a distal end part 14*a* of the ground electrode 14 faces a distal end surface 15*a* of a noble metal chip 15 on the central electrode 13 (see FIG. 2).

The ground electrode 14 is made of a nickel based alloy. The ground electrode 14 is composed of a base part 14*m* and a noble metal chip 16 (as a first noble metal chip).

As shown in FIG. 2, the central electrode 13 has the noble metal chip 15. The ground electrode 14 has the noble metal chip 16. Each of the noble metal chip 15 and the noble metal chip 16 has a cylindrical shape. Each of the noble metal chip 15 and the noble metal chip 16 is made of an iridium rhodium (IrRh) alloy in which rhodium is added into iridium, where Ir has a superior wear resistance at a high melting point, and Rh suppress a volatile function of iridium at a high temperature.

The noble metal chip 15 is fixed to the distal end part 13*a* of the central electrode 13 by a laser welding or a resistance welding. Similarly, the noble metal chip 16 is fixed to the distal end part 14*a* of the ground electrode 14 by a laser welding or a resistance welding.

A spark gap 17 is formed between the distal end surface 15*a* of the noble metal chip 15 (second noble metal chip) and a distal end surface 16*a* of the noble metal chip 16 (first noble metal chip).

As shown in FIG. 1, a central axis 18 and a terminal 19 are electrically connected together at the upper side of the central electrode 13 in the spark plug 10.

The terminal 19 is connected to an external circuit which generates and supplies a high voltage to the spark plug 10 so as to generate a discharge spark between the central electrode 13 and the ground electrode 14.

A gasket 20 is arranged at the upper end of the screw part 11*a* of the metal shell 11. The spark plug 10 is mounted to an internal combustion engine (omitted from drawings) through the gasket 20.

When the spark plug 10 is mounted on an internal combustion engine, the central electrode 13 and the ground electrode 14 of the spark plug 10 are exposed inside of a combustion chamber of the internal combustion engine. A direction from the central electrode 13 toward the ground electrode 14 corresponds to a direction toward a center of the combustion chamber.

Figure 3:
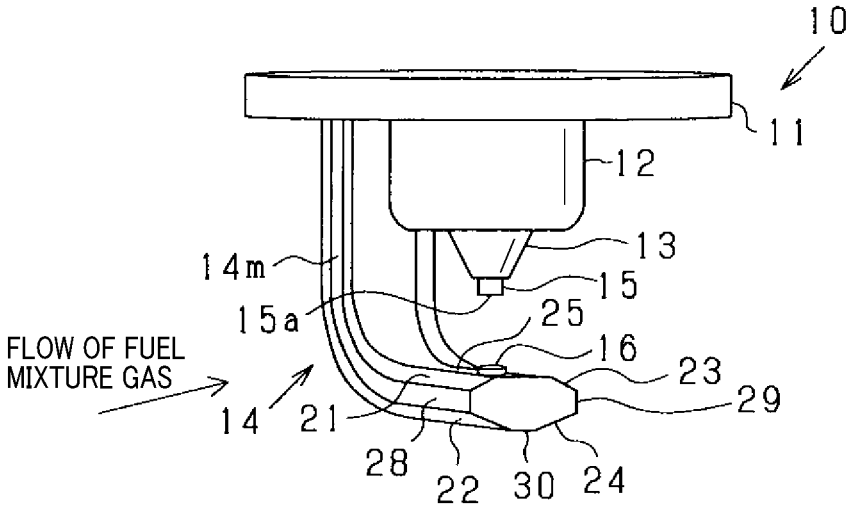
FIG. 3 is a perspective view showing a distal end part of a central electrode and a ground electrode in the spark plug shown in FIG. 2.
Figure 4:
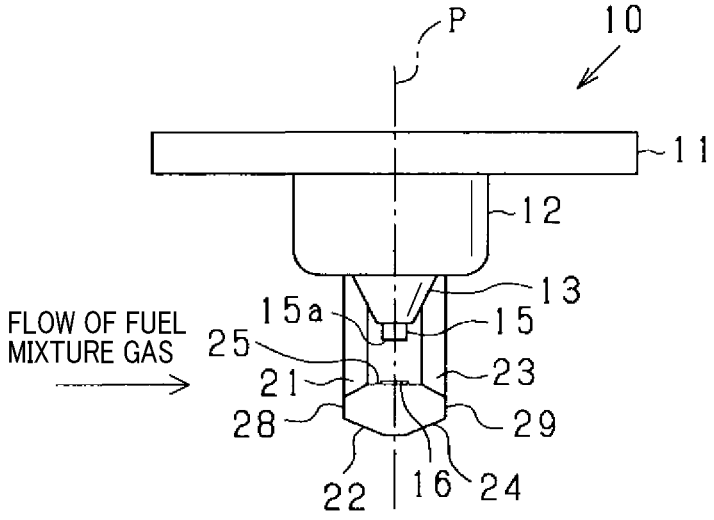
FIG. 4 is a front view showing the distal end part of the central electrode and the ground electrode in the spark plug shown in FIG. 3.

FIG. 3 is a perspective view showing the distal end part 13*a* of the central electrode 13 and the ground electrode 14 in the spark plug 10 shown in FIG. 2. FIG. 4 is a front view showing the distal end part 13*a* of the central electrode 13 and the ground electrode 14 in the spark plug 10 shown in FIG. 3. In the structure of the spark plug 10 according to the exemplary embodiment, a cross section of the base part 14*m* of the ground electrode 14 has a polygon, i.e. an octagonal shape shown in FIG. 3.

In the combustion chamber of the internal combustion engine, the spark plug 10 is arranged so that a virtual plane P (see FIG. 4) is arranged along the curved ground electrode 14 to be perpendicular to a flow of the fuel mixture gas.

In the structure of the spark plug 10 according to the exemplary embodiment, a facing surface 25 is formed on the base part 14*m* of the ground electrode 14 at the position on the base part 14*m* facing the distal end surface 15*a* of the central electrode 13 to have a shortest gap between the facing surface 25 and the distal end surface 15*a* of the central electrode 13. That is, the distance between the distal end surface 15*a* of the noble metal chip 15 on the central electrode 13 and the facing surface 25 has the shortest gap in the spark gap. The noble metal chip 16 is formed on the facing surface 25 of the ground electrode 14.

That is, the distance between the distal end surface 15*a* of the noble metal chip 15 on the central electrode 13 and the base part 14*m* of the ground electrode 14 has the shortest gap. The facing surface 25 has a flat surface at a position facing the central electrode 13. The ground electrode 14 has a curved part and a plane part. As shown in FIG. 3, the curved part and the flat are formed from the facing surface 25 to a connection point at which the ground electrode 14 is connected to the metal shell 11. The noble metal chip 16 is fixed onto the facing surface 25 of the ground electrode 14. As shown in FIG. 2, the distance between the distal end surface 16*a* of the noble metal chip 16 and the distal end surface 15*a* of the noble metal chip 15 of the central electrode 13 has the shortest gap.

Figure 5:
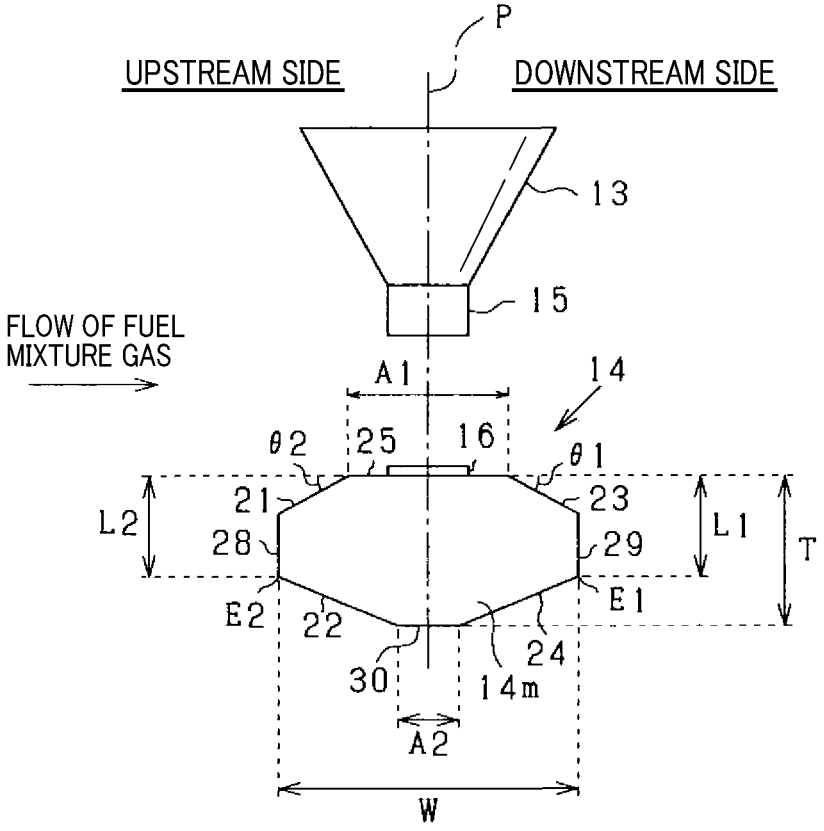
FIG. 5 is a schematic view showing dimensions of the ground electrode in the spark plug shown in FIG. 3.

FIG. 5 is a schematic view showing each of dimensions of the ground electrode 14 in the spark plug shown in FIG. 3. As shown in FIG. 3, FIG. 4 and FIG. 5, a first slope surface 23 is formed on an upper surface of the base part 14*m* of the ground electrode 14. The first slope surface 23 is formed on the base part 14*m* at a downstream side in the flow direction of the fuel mixture gas, facing the distal end surface 15*a* of the noble metal chip 15 of the central electrode 13. That is, the first slope surface 23 is formed adjacent to and connected to the facing surface 25 of the ground electrode 14 and increasingly away from the distal end surface 15*a* of the noble metal chip 15 in the flow direction of the fuel mixture gas.

The first slope surface 23 of the ground electrode 14 has a flat surface at the opposing position to the central electrode 13. As shown in FIG. 3, a curved surface and a flat surface are formed from the first slope surface 23 to the connection position with the metal shell 11 on the ground electrode 14.

The ground electrode 14 is formed to have plane symmetry with respect to the virtual plane P (see FIG. 4). A third slope surface 21 is formed, facing the distal end surface 15*a* of the noble metal chip 15 of the central electrode 13, on the upper surface of the base part 14*m* of the ground electrode 14. The third slope surface 21 is formed on the upper surface of the base part 14*m* at the upstream side of the central electrode 13, and connected to the facing surface 25, approaching the distal end surface 15*a* of the central electrode 13 in the flow direction of the fuel mixture gas. The third slope surface 21 of the ground electrode 14 is formed to deflect the fuel mixture gas toward the central electrode 13 side.

A downstream-side end surface 29 is formed at the most downstream side in the flow direction of the fuel mixture gas and parallel with the virtual plane P in the base part 14*m* of the ground electrode 14. The downstream-side end surface 29 is connected to the first slope surface 23. The downstream-side end surface 29 forms one side surface of the base part 14*m* of the ground electrode 14. The downstream-side end surface 29 has a shape corresponding to the curved base part 14*m* of the ground electrode 14.

Because the ground electrode 14 has plane symmetry with respect to the virtual plane P (see FIG. 4), an upstream-side end surface 28 is formed at the most upstream side in the flow direction of the fuel mixture gas and parallel with the virtual plane P in the base part 14*m* of the ground electrode 14. The upstream-side end surface 28 is connected to the third slope surface 21. The upstream-side end surface 28 has a shape corresponding to the curved base part 14*m* of the ground electrode 14.

As shown in FIG. 3, FIG. 4 and FIG. 5, a second slope surface 24 is formed on a lower surface of the base part 14*m* of the ground electrode 14. The second slope surface 24 is formed at the downstream side in the flow direction of the fuel mixture gas, and approaching the distal end surface 15*a* of the central electrode 13 in the flow direction of the fuel mixture gas. The second slope surface 24 is formed connected to the downstream-side end surface 29 and has a slope shape formed from the upstream side toward the downstream side in the flow direction of the fuel gas mixture at the bottom side of the ground electrode 14. The second slope surface 24 has a flat surface on the bottom side of the ground electrode 14 at the position away from the central electrode 13.

As shown in FIG. 3, a curved surface and a flat surface are formed from the second slope surface 24 to the connection position with the metal shell 11 on the ground electrode 14.

The ground electrode 14 is formed to have plane symmetry with respect to the virtual plane P (see FIG. 4). A fourth slope surface 22 is formed on the lower surface of the base part 14*m* of the ground electrode 14. The fourth slope surface 22 is formed connected to the upstream-side end surface 28 and the opposing surface 30, and is formed on the lower surface of the base part 14*m*, increasingly away from the distal end surface 15*a* of the central electrode 13 in the flow direction of the fuel mixture gas. The fourth slope surface 22 of the ground electrode 14 is formed to deflect the fuel mixture gas in a direction away from the central electrode 13.

Further, an opposing surface 30 is formed on the lower surface of the base part 14*m* of the ground electrode 14 furthest from the distal end surface 15*a* of the noble metal chip 15 of the central electrode 13.

The base part 14*m* of the ground electrode 14, excepting the noble metal chip 16, is formed by bending a member having a straight direction. This structure makes it possible to enhance the productivity of the ground electrode 14. Furthermore, the base part 14*m* of the ground electrode 14 is formed to have plane symmetry with respect to the virtual plane P, i.e. the upstream side and the downstream side (see FIG. 4). Accordingly, this makes it possible to increase the productivity of the spark plug 10.

FIG. 5 is a schematic view showing dimensions of the ground electrode 14 shown in FIG. 3. That is, FIG. 5 shows a cross section parallel to the flow direction of the fuel mixture gas and shows dimensions of components forming the ground electrode 14.

In a direction along a central axis of the central electrode 13 (which is an insertion direction of the central electrode 13 into the metal shell 11 and the insulator 12), parallel with the virtual plane P, in the spark plug 10 according to the exemplary embodiment shown in FIG. 5, the reference character T represents a thickness of the base part 14*m* of the ground electrode 14.

The reference character L1 represents a distance (as a first distance L1) measured, parallel to the central axis of the central electrode to which the central electrode is disposed into the metal shell, from a connection point E1 between the second slope surface 24 and the downstream-side end surface 29 to the facing surface 25 of the base part 14*m* of the ground electrode 14.

The reference character L2 represents a distance (as a second distance L2) measured in the direction along the central axis of the central electrode 13 from a connection point E2 between the fourth slope surface 22 and the upstream-side end surface 28 to the facing surface 25 of the ground electrode 14.

The spark plug 10 according to the exemplary embodiment has an improved structure in which the thickness T satisfies a relationship of 1.1 mm≤T≤1.5 mm.

It is preferable for the thickness T to satisfy the relationship of 1.2 mm≤T≤1.4 mm.

Further, the spark plug 10 according to the exemplary embodiment has the improved structure in which the distance L1 satisfies a relationship of 0.3 mm≤L1≤0.9 mm, and the distance L2 satisfies a relationship of 0.3 mm≤L2≤0.9 mm.

It is preferable for the distance L1 and the distance L2 to satisfy the relationship of 0.5 mm≤L1≤0.7 mm, and the relationship of 0.5 mm≤L2≤0.7 mm.

In the structure of the spark plug according to the exemplary embodiment, the distance L1 is equal to the distance 12 (L1=L2).

In a direction which is perpendicular to the central axis of the central electrode 13, parallel with the virtual plane P, of the spark plug 10 according to the exemplary embodiment shown in FIG. 5, the reference character W represents a width of the base part 14*m* of the ground electrode 14 with respect to the direction of the flow direction of the fuel mixture gas, which is perpendicular to the virtual plane P.

The reference character A1 represents a width of the facing surface 25 of the ground electrode 14. The reference character A2 represents a width of the opposing surface 30 formed on the lower surface of the base part 14*m* of the ground electrode 14.

The spark plug 10 according to the exemplary embodiment has the improved structure in which the width W of the base part 14*m* of the ground electrode 14 satisfies a relationship of 2.3 mm≤W≤2.9 mm. It is preferable for the width W of the base part 14*m* to satisfy the relationship of 2.5 mm≤W≤2.7 mm.

The spark plug 10 according to the exemplary embodiment has the improved structure in which the width A1 of the facing surface 25 of the ground electrode 14 satisfies the relationship of 1.2 mm≤A1≤1.8 mm. It is preferable for the width A1 of the facing surface 25 of the ground electrode 14 to satisfy the relationship of 1.4 mm≤A1≤1.6 mm.

The spark plug 10 according to the exemplary embodiment has the improved structure in which the width A2 of the opposing surface 30 satisfies the relationship of 0.3 mm≤A2≤0.7 mm. It is preferable for the width A2 of the opposing surface 30 to satisfy the relationship of 0.4 mm≤A2≤0.6 mm.

In the direction perpendicular to the virtual plane P shown in FIG. 5, the width A1 of the facing surface 25 formed on the upper surface of the ground electrode 14 is wider than the width A2 of the opposing surface 30 formed on the lower surface of the base part 14*m* of the ground electrode 14.

In the structure of the base part 14*m* of the ground electrode 14 shown in FIG. 5, the reference character θ1 represents an angle (as a first angle θ1) of the facing surface 25 to the first slope surface 23 of the ground electrode 14. The reference character θ2 represents an angle (as a second angle θ2) of the facing surface 25 to the third slope surface 21 of the ground electrode 14. The angle θ1 satisfies the relationship of 10°≤θ1≤40°, and the angle θ2 satisfies the relationship of 10°≤θ2≤40°. It is preferable for the angle θ1 to satisfy the relationship of 15°≤θ1≤25°, and for the angle θ2 to satisfy the relationship of 15°≤θ2≤25°.

In the structure of the spark plug 10 according to the exemplary embodiment, the angle θ1 is equal to the angle θ2.

Figure 6:
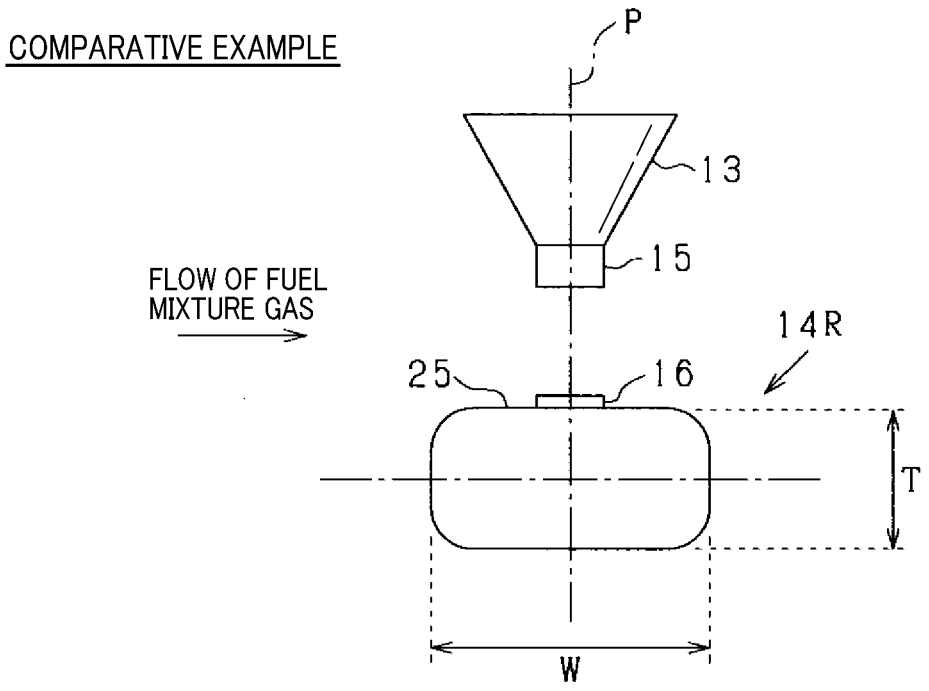
FIG. 6 is a schematic view showing dimensions of a ground electrode in a spark plug according to a comparative example.

FIG. 6 is a schematic view showing dimensions of a ground electrode 14R in a comparative example. That is, FIG. 6 shows a cross section of the ground electrode 14R, which is parallel with a surface of the flow direction of the fuel mixture gas along the central axis of the central electrode 13.

In a direction along the central axis of the central electrode 13 (which is an insertion direction of the central electrode 13 into the metal shell 11 and the insulator 12), parallel with a virtual plane P in the spark plug according to the comparative example shown in FIG. 6, the reference character T represents a thickness of a base part of the ground electrode 14R.

In the base part of the ground electrode 14R, the reference character W represents a width of the base part of the ground electrode 14R in a direction, along which the fuel mixture gas flows, which is perpendicular to the virtual plane P.

The spark plug 10 according to the comparative example shown in FIG. 6 has the thickness T of 1.3 mm and the width W of 2.6 mm, and preferably satisfies a relationship of 1.1 mm≤T≤1.5 mm.

As shown in FIG. 6, the spark plug according to the comparative example shown in FIG. 6 does not have the first slope surface 23, the second slope surface 24, the third slope surface 21 and the fourth slope surface 22. That is, a cross section of the base part of the ground electrode 14R is a polygon, i.e. an octagonal shape (see FIG. 3).

Figure 7:
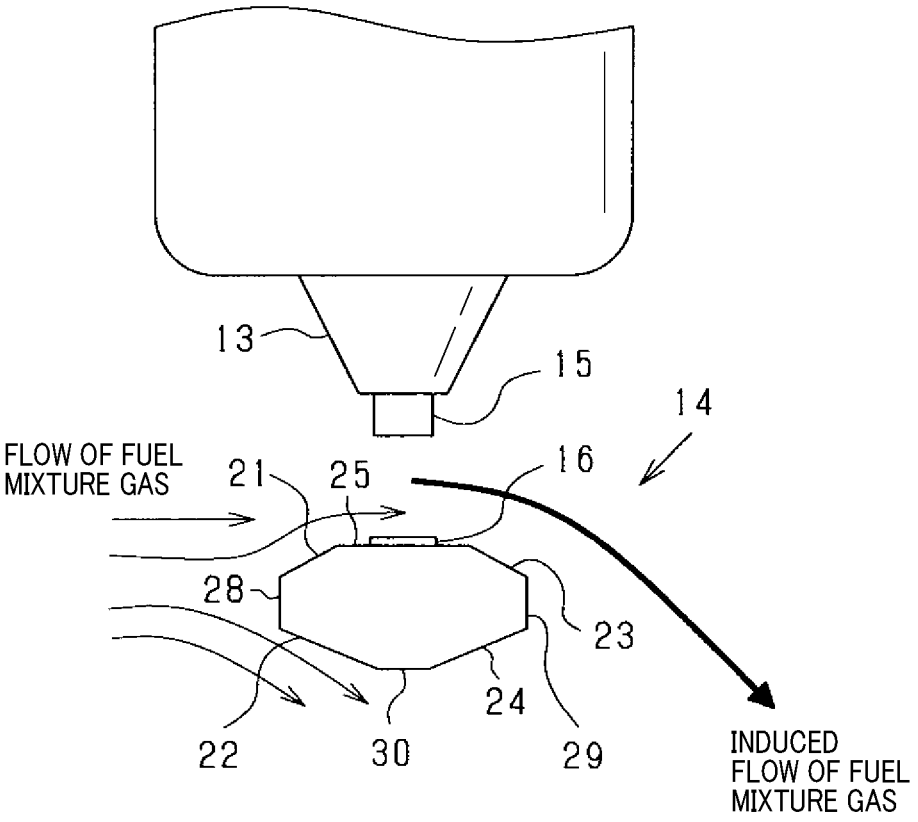
FIG. 7 is a schematic view showing an induced flow of a fuel mixture gas flowing through a spark gap formed between the central electrode and the ground electrode in the spark plug according to the exemplary embodiment shown in FIG. 1.

FIG. 7 is a schematic view showing an induced flow of the fuel mixture gas flowing through the spark gap formed between the central electrode 13 and the ground electrode 14 in the spark plug 10 according to the exemplary embodiment shown in FIG. 1.

After a part of the fuel mixture gas flowing to the ground electrode 14 hits the third slope surface 21, this part of the fuel mixture gas is guided to the spark gap, i.e. to the area between the noble metal chip 15 of the central electrode 13 and the noble metal chip 16 of the ground electrode 14 along the third slope surface 21. That is, this part of the fuel mixture gas is regulated by the spark gap between the noble metal chip 15 of the central electrode 13 and the noble metal chip 16 of the ground electrode 14.

After the fuel mixture gas hits the fourth slope surface 22, the fuel mixture gas is guided away from the ground electrode 14 along the fourth slope surface 22. This generates a negative pressure at a downstream side of the second slope surface 24 and the downstream-side end surface 29 of the ground electrode 14. Because the second slope surface 24 is formed on the base part of the ground electrode 14, the flow direction of the fuel mixture gas is easily separated from the ground electrode 14, and this increases a magnitude of the negative pressure at the downstream side of the second slope surface 24.

The fuel mixture gas passing through the spark gap formed between the noble metal chip 15 of the central electrode 13 and the noble metal chip 16 of the ground electrode 14 is guided away from the central electrode 13 by a negative pressure generated at the downstream side of the second slope surface 24 and the downstream-side end surface 29 of the ground electrode 14. Because the first slope surface 23 is formed on the upper side of the base part 14*m* of the ground electrode 14, the fuel mixture gas is guided away from the central electrode 13 along the first slope surface 23 shown in FIG. 7.

Figure 8:
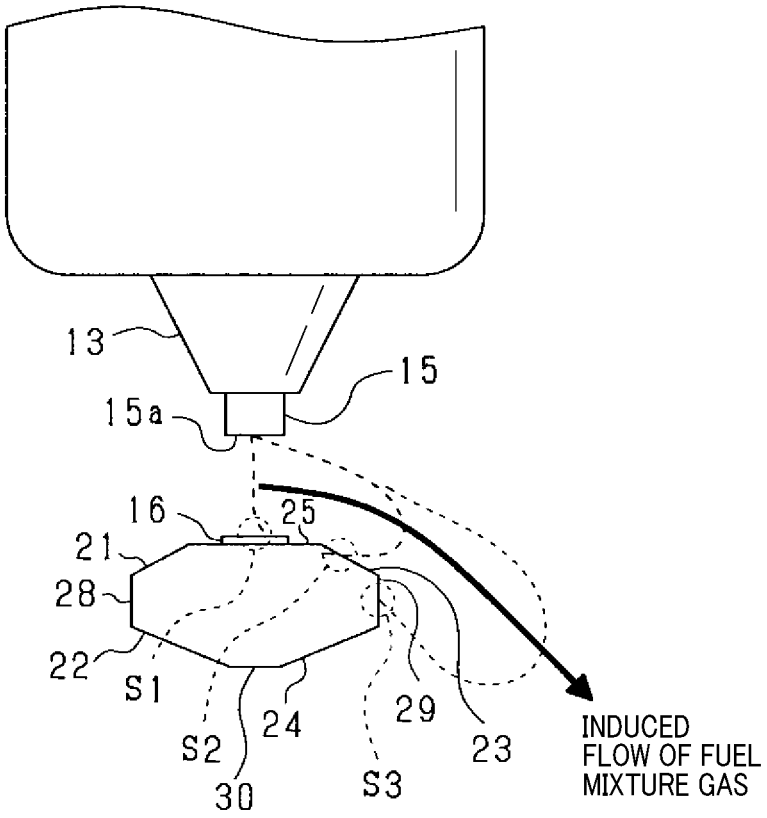
FIG. 8 is a view showing a direction in which a discharge spark generated between a spark gap between the central electrode and the ground electrode in the spark plug shown in FIG. 1 is induced.

FIG. 8 is a view showing a direction in which a discharge spark generated between the spark gap between the central electrode 13 and the ground electrode 14 in the spark plug 1 shown in FIG. 1 is induced.

As shown in FIG. 8, a discharge spark is generated at a discharge spark first start point S1 between the distal end surface 15*a* of the noble metal chip 15 of the central electrode 13 and the distal end surface 16*a* of the noble metal chip 16 of the ground electrode 14. The discharge spark is stably extended by the flow direction of the fuel mixture gas regulated between the noble metal chip 15 and the noble metal chip 16 toward the downstream side.

After this, the discharge spark start point S1 moves to a discharge spark second start point S2 on the first slope surface 23. Accordingly, this makes it possible for the discharge spark to move from the first start point S1 toward the discharge spark second start point S2, and to extend, i.e. increase a distance between the discharge start point on the ground electrode 14 and the distal end surface 15*a* of the noble metal chip 15 of the central electrode 13. This makes it possible to suppress a short circuit from occurring in the extended discharge spark.

As has been explained by using FIG. 7, the fuel mixture gas passed through the spark gap between the noble metal chip 15 of the central electrode 13 and the noble metal chip 16 of the ground electrode 14 is guided toward a direction away from the central electrode 13 by a negative pressure generated at the downstream side of the second slope surface 24 and the downstream-side end surface 29 of the ground electrode 14. The discharge spark is extended away from the central electrode 13 by the flow direction of the fuel mixture gas. At this time, the discharge spark start point moves from a second start point S2 to a discharge spark third start point S3 on the downstream-side end surface 29. Further, the discharge spark third start point S3 is moved to a position which is further from the central electrode 13 along the downstream-side end surface 29.

This makes it possible to provide a stable discharge spark in a direction away from the central electrode 13, and to increase the ignitability of a fuel mixture gas. The longer the discharge spark is, the larger a total surface area of the discharge spark is, and the larger a contact surface of the fuel mixture gas with the discharge spark is. This increases the ignitability of the fuel mixture gas. Further, the further the discharge spark is extended away the central electrode 13, i.e. the more it approaches a middle point in the combustion chamber of the internal combustion engine. This increases the combustion quality of the fuel mixture gas in the combustion chamber of the internal combustion engine.

Figure 9:
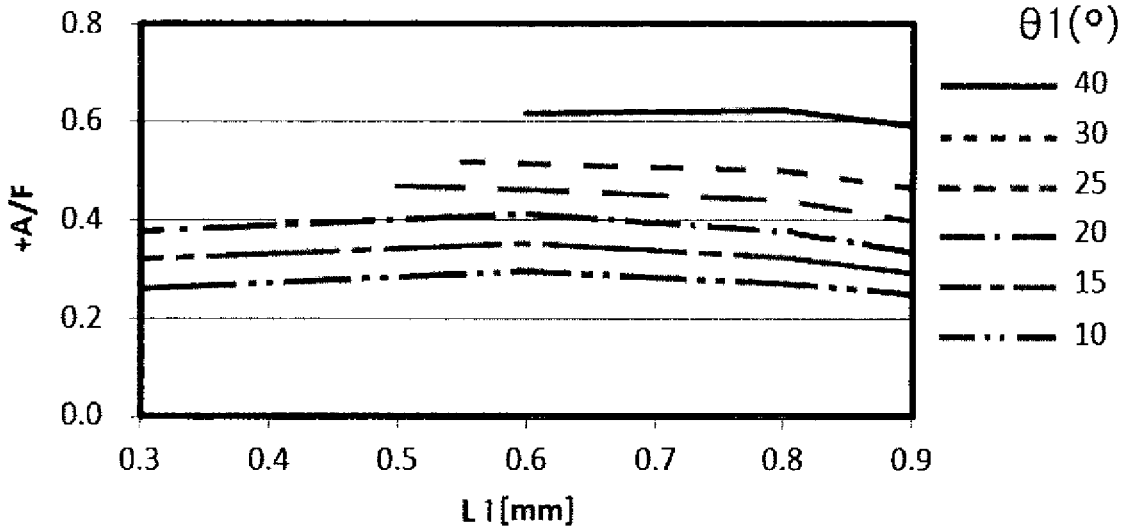
FIG. 9 is a graph showing experimental results regarding a relationship between a distance L1, an increased A/F value for various values of the angle θ1 shown in FIG. 5.

FIG. 9 is a graph showing experimental results regarding a relationship between the distance L1, an increased A/F (air/fuel) value for various values of the angle θ1 shown in FIG. 5. That is, as shown in FIG. 5 and previously explained, the angle θ1 represents the angle of the facing surface 25 to the first slope surface 23 of the ground electrode 14, and the distance L1 is measured in the central axis of the central electrode 13 from the facing surface 25 of the ground electrode 14 to the connection point E1 between the second slope surface 24 and the downstream-side end surface 29. The increased A/F value represents an increased value of a lean A/F value of the ground electrode 14 to a reference value of zero when a lean limit A/F value of a fuel mixture gas at the ground electrode 14R of the spark plug according to the comparative example.

The exemplary embodiment performed an experiment of test samples to determine the increased A/F value. The experiment using the test samples having fixed values, i.e. the width W of 2.6 mm, the thickness T of 1.3 mm, the width A1 if 1.0 mm, the width A2 of 0.5 mm, a diameter Φ of 0.7 mm of the noble metal chip 16, and a height of 0.15 mm of the noble metal chip 16.

The experiment according to the exemplary embodiment of the present disclosure found that the fuel mixture gas is not affected by variation of the diameter Φ and the height. This means that a dimension of each of the diameter Φ and the height is smaller than the dimension of the base part 14*m*, of the ground electrode 14.

As shown in FIG. 9, each test sample has the increased A/F value of not less than 0.2. In particular, each of the test samples satisfying a relationship of 0.5 mm≤L1≤0.8 mm and 25°≤θ1≤40° has the increased A/F value of not less than 0.4.

Accordingly, it is possible for the spark plug to have the increased ignitability of a fuel mixture gas when satisfying a specific relationship of 0.3 mm≤L1≤0.9 mm, and 10°≤θ1≤40°.

More preferably, it is possible for the spark plug to have the increased ignitability of a fuel mixture gas when satisfying a specific relationship of 0.5 mm≤L1≤0.8 mm, and 25°≤θ1≤40°.

Even more preferably, it is also possible for the spark plug to have the increased ignitability of a fuel mixture gas when satisfying a specific relationship of 0.5 mm≤L1≤0.7 mm.

It has been recognized that a test sample has the increased A/F value of not less than zero when satisfying specific ranges of 0.3≤L2≤0.9 mm, and 10°≤θ2≤40°.

It has been recognized that a test sample has the increased A/F value of not less than zero when satisfying other specific ranges of 1.1≤T≤1.5 mm, 2.3≤W≤2.9 mm, 1.2≤A1≤1.8 mm and 0.3≤A2≤0.7 mm.

In order to increase the productivity of the main part 14 of the ground electrode 14, it is preferable to produce the spark plug having a structure in which the distance L1 satisfies the relationship of 0.5≤L1≤0.7 mm, and the angle θ1 satisfies the relationship of 15°≤θ1≤25°. This structure makes it possible to suppress a sharp part from being generated at the base part 14*m* of the ground electrode 14. This increases the productivity of the spark plug 10.

It is preferable for the angle θ2 to satisfy the relationship of 25°≤θ1≤40° when the angle θ1 satisfies the relationship of 25°≤θ1≤40°.

Further, it is preferable for the distance L2 to satisfy the relationship of 0.5≤L2≤0.8 mm when the distance L1 satisfies the relationship of 0.5≤L1≤0.8 mm, (L1=L2).

Figure 10:
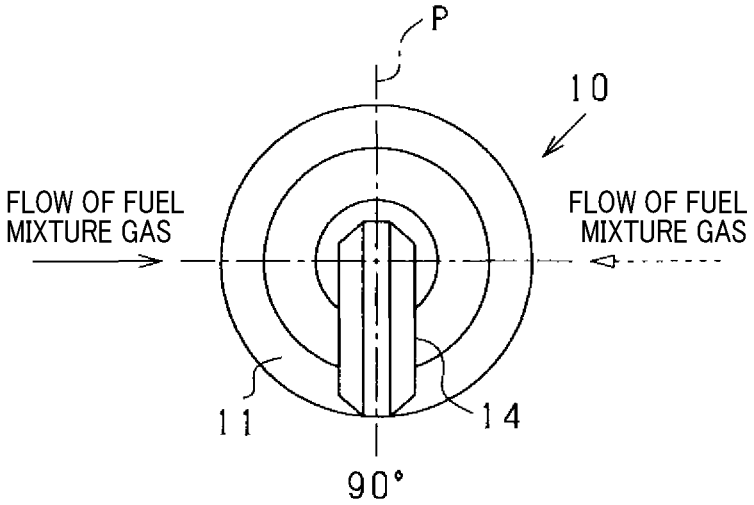
FIG. 10 is a schematic view showing a phenomenon in which a backflow of a discharge spark occurs in the spark plug shown in FIG. 1.

FIG. 10 is a schematic view showing a phenomenon in which a backflow of the discharge spark occurs in the spark plug 10 shown in FIG. 1.

When a spark plug is mounted on a combustion chamber of an internal combustion engine (not shown), there is a possible case in which a backflow of a fuel mixture gas temporarily occurs in a combustion chamber (not shown), as designated by the dotted arrow shown in FIG. 10, against the formal flow of the fuel mixture gas.

On the other hand, the spark plug 10 according to the exemplary embodiment has the ground electrode 14 is formed to have plane symmetry with respect to the virtual plane P shown in FIG. 10. That is, the spark plug 10 according to the exemplary embodiment has the improved structure in which the distance L1 and the distance L2 are the same, and the angle θ1 and the angle θ2 are the same. In this improved structure, the first slope surface 23 performs the function of the third slope surface 21, and the second slope surface 24 performs the function of the fourth slope surface 22 even if a back flow of the fuel mixture gas temporarily occurs in the combustion chamber during the combustion process. Accordingly, this structure makes it possible to improve the ignitability of the fuel mixture gas even if a back flow of the fuel mixture gas temporarily occurs in the combustion chamber during the combustion process.

Figure 11:
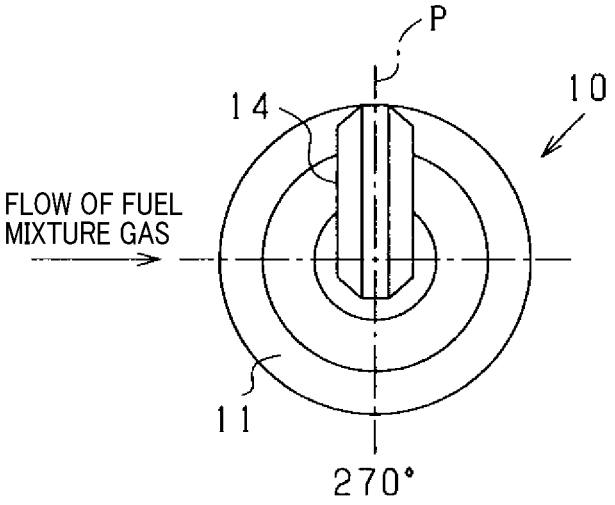
FIG. 11 is a schematic view showing a reverse arrangement of the spark plug when compared with the arrangement of the spark plug shown in FIG. 10.

FIG. 11 is a schematic view showing a reverse arrangement of the spark plug 10 when compared with the arrangement of the spark plug shown in FIG. 10.

The arrangement direction of the ground electrode 14 in the spark plug 10 shown in FIG. 11 is reversed to the arrangement direction of the ground electrode 14 shown in FIG. 10. The mounting angle of the ground electrode 14 shown in FIG. 11 is different from the mounting angle of the ground electrode 14 shown in FIG. 10. That is, it is possible to improve the ignitability of the fuel mixture gas even if the ground electrode 14 is arranged in a reverse direction shown in FIG. 11 when compared with the arrangement direction of the ground electrode 14 shown in FIG. 10, similar to the occurrence of a back flow of the fuel mixture gas in the combustion chamber during the combustion process.

A description will now be given of advantages of the spark plug 10 according to the exemplary embodiment having the improved structure previously described.

In the spark plug 10 according to the exemplary embodiment, the facing surface 25 is formed on the base part 14*m* of the ground electrode 14 at the position facing the distal end surface 15*a* of the central electrode 13. This structure makes it possible to suppress the flow direction of the fuel mixture gas passing through the spark gap between the central electrode 13 and the ground electrode 14 from undergoing turbulence. This structure of the spark plug 10 makes it possible to further suppress the discharge spark from being unstable.

Further, the first slope surface 23 is formed on the upper surface of the base part 14*m* of the ground electrode 14. The first slope surface 23 is formed at the downstream side in the flow direction of the fuel mixture gas, and faces the distal end surface 15*a* of the noble metal chip 15 of the central electrode 13. The first slope surface 23 is formed adjacent to the facing surface 25 of the ground electrode 14, and away from the distal end surface 15*a* of the noble metal chip 15 along the direction from the upstream side toward the downstream side in the flow direction of the fuel mixture gas.

This structure makes it possible to guide the fuel mixture gas, passed through the spark gap between the central electrode 13 and the ground electrode 14, into the central area in the combustion chamber. As a result, this makes it possible to reduce the cooling loss of the generated discharge spark, and to improve the ignitability of the fuel mixture gas by the spark plug 10.

In the structure of the spark plug according to the exemplary embodiment, the downstream-side end surface 29 is formed at the most downstream side in the flow direction of the fuel mixture gas and parallel with the virtual plane P in the base part 14*m* of the ground electrode 14. The second slope surface 24 is formed on the lower surface of the base part 14*m* of the ground electrode 14. The second slope surface 24 is formed at the downstream side in the flow direction of the fuel mixture gas and faces away from the distal end surface 15*a* of the noble metal chip 15 of the central electrode 13. Further, the opposing surface 30 is formed on the lower surface of the base part 14*m* of the ground electrode 14 away from the distal end surface 15*a* of the noble metal chip 15 of the central electrode 13.

In the structure of the spark plug 10 according to the exemplary embodiment, the fuel mixture gas flows is away from the downstream-side end surface 29 and the second slope surface 24 by the formation of the first slope surface 23 and the opposing surface 30. This generates a negative pressure at the downstream side of the downstream-side end surface 29 and the second slope surface 24. Accordingly, the fuel mixture gas and the discharge spark generated between the central electrode 13 and the ground electrode 14 are guided by the generated negative pressure toward the direction to be more away from the central electrode 13. This makes it possible to extend the discharge spark from the central electrode 13 away from the central electrode 13, and improve the ignitability of the fuel mixture gas.

Still further, because the discharge spark start point moves along the first slope surface 23 from the upstream side to the downstream side of the fuel mixture gas, this makes it possible to extend the distance between the discharge spark start point and the central electrode 13, and to prevent a short circuit from occurring in the middle area of the discharge spark.

Further, in the structure of the spark plug 10 according to the exemplary embodiment, the width A1 of the facing surface 25 formed on the upper surface of the ground electrode 14 is wider than the width A2 of the opposing surface 30 formed on the lower surface of the base part 14*m* of the ground electrode 14. The angle θ1 of the facing surface 25 to the first slope surface 23 of the ground electrode 14 satisfies the relationship of $10° \leq \theta 1 \leq 40°$.

When the distance L1 measured in the central axis of the central electrode 13 from the facing surface 25 of the ground electrode 14 to the connection point E1 between the second slope surface 24 and the downstream-side end surface 29 satisfies the relationship of $0.3\ \text{mm} \leq L1 \leq 0.9\ \text{mm}$, this structure makes it possible to improve the ignitability of the fuel mixture gas. The experiment according to the exemplary embodiment of the present disclosure showed that the improved structure of the spark plug 10 makes it possible to increase the ignitability of the fuel mixture gas in a combustion chamber of an internal combustion engine.

In the structure of the spark plug 10 according to the exemplary embodiment, the first slope surface 23 and the second slope surface 24 are connected together through the downstream-side end surface 29 which is the most lower side plane surface in the flow direction of the fuel mixture gas parallel with the virtual plane P. This structure makes it possible to increase the angle between the first slope surface 23 and the downstream-side end surface 29, and to increase the angle between the downstream-side end surface 29 and the second slope surface 24 larger than the angle between the first slope surface 23 and the second slope surface 24 in a case when the first slope surface 23 and the second slope surface 24 are directly connected together. This structure makes it possible to suppress a sharp part from being generated on the ground electrode 14, and to increase the productivity of the spark plug 10.

In the structure of the spark plug 10 according to the exemplary embodiment previously explained, it is possible for the angle θ1 to satisfy the relationship of $15° \leq \theta 1 \leq 25°$. This structure makes it possible to increase the angle between the first slope surface 23 and the downstream-side end surface 29 on the base part 14*m* of the ground electrode 14. This structure further increases the productivity of the spark plug 10.

When the distance L1 satisfies the relationship of $0.5\ \text{mm} \leq L1 \leq 0.7\ \text{mm}$, it is possible to further improve the ignitability of the fuel mixture gas.

When the base part 14*m* of the ground electrode 14 has the structure which satisfies the relationship of $25° \leq \theta 1 \leq 40°$ and the relationship of $0.5 \leq L1 \leq 0.8\ \text{mm}$, it is possible to further improve the ignitability of the fuel mixture gas.

The third slope surface 21 is formed, facing the distal end surface 15*a* of the noble metal chip 15 of the central electrode 13, on the upper surface of the base part 14*m* of the ground electrode 14. The third slope surface 21 is formed at the upstream side of the central electrode 13 and connected to the facing surface 25 while closing to the distal end surface 15*a* of the noble metal chip 15 of the central electrode 13 from the upstream side toward the downstream side in the flow direction of the fuel mixture gas. The facing surface 25 is formed on the base part 14*m* of the ground electrode 14 at the position facing the distal end surface 15*a* of the central electrode 13. A distance between the distal end surface 15*a* of the noble metal chip 15 on the central electrode 13 and the facing surface 25 is a minimum distance therebetween, i.e. has the shortest gap therebetween. The formation of the third slope surface 21 makes it possible to regulate the fuel mixture gas flowing into the spark gap between the central electrode 13 and the ground electrode 14. This structure makes it possible to stably extend the discharge spark.

The upstream-side end surface 28 is formed at the most upstream side in the flow direction of the fuel mixture gas and parallel with the virtual plane P in the base part 14*m* of the ground electrode 14. The upstream-side end surface 28 is connected to the third slope surface 21.

The fourth slope surface 22 is formed on the lower surface of the base part 14*m* of the ground electrode 14. The fourth slope surface 22 is formed connected to the upstream-side end surface 28 and the opposing surface 30, and is away from the upstream side toward the downstream side in the flow direction of the fuel mixture gas at the opposite of the distal end surface 15*a* of the noble metal chip 15 of the central electrode 13.

After the fuel mixture gas hits the fourth slope surface 22, the fuel mixture gas is guided away from the ground electrode 14 along the fourth slope surface 22. This generates a negative pressure at the downstream side of the second slope surface 24 and the downstream-side end surface 29 of the ground electrode 14. The discharge spark and the fuel mixture gas passed through the spark gap between the central electrode 13 and the ground electrode 14 are extended toward the direction away from the central electrode 13. This makes it possible to extend the discharge spark away from the central electrode 13, and to improve the ignitability of the fuel mixture gas.

The angle θ2 represents the angle of the facing surface 25 to the third slope surface 21 of the ground electrode 14. The angle θ2 satisfies the relationship of $10° \leq \theta 2 \leq 40°$. The distance L2 represents the distance measured in the direction along the central axis of the central electrode 13 from the connection point E2 between the fourth slope surface 22 and the upstream-side end surface 28 to the facing surface 25 of the ground electrode 14. The distance L2 satisfies the relationship of $0.3\ \text{mm} \leq L2 \leq 0.9\ \text{mm}$. The experiment according to the exemplary embodiment of the present disclosure found that this structure makes it possible to improve the ignitability of the fuel mixture gas. Accordingly, the spark plug 10 having the structure previously described makes it possible to increase the ignitability of the fuel mixture gas.

The third slope surface 21 and the fourth slope surface 22 are connected through the upstream face, i.e. through the upstream-side end surface 28 which is arranged, parallel with the virtual plane P, at the most upstream side in the flow direction of the fuel mixture gas.

When the third slope surface 21 and the fourth slope surface 22 are connected together through the upstream-side end surface 28 which is the most upper side plane surface in the flow direction of the fuel mixture gas parallel, it is possible to increase the angle between the third slope surface 21 and the upstream-side end surface 28 and to increase the angle between the upstream-side end surface 28 and the fourth slope surface 22 larger than the angle between the third slope surface 21 and the fourth slope surface 22 in a case when the first slope surface 23 and the second slope surface 24 are directly connected together. This structure makes it possible to suppress a sharp part from being produced on the ground electrode 14, and to increase the productivity of the spark plug 10.

In the structure of the spark plug 10 according to the exemplary embodiment, because the angle θ2 satisfies the relationship of $15° \leq \theta 2 \leq 25°$, this makes it possible to further increase the angle between the third slope surface 21 and the upstream-side end surface 28. This makes it possible to further increase the productivity of the spark plug 10.

In the structure of the spark plug 10 according to the exemplary embodiment, because the angle θ1 and the angle θ2 have the same value, and the distance L1 and the distance L2 have the same value.

In the improved structure of the spark plug 10, the first slope surface 23 performs the function of the third slope surface 21, and the second slope surface 24 performs the function of the fourth slope surface 22 even if a back flow of the fuel mixture gas temporarily occurs in the combustion chamber during the combustion process. Similarly, the third slope surface 21 performs the function of the first slope surface 23, and the fourth slope surface 22 performs the function of the second slope surface 24 even if a back flow of the fuel mixture gas temporarily occurs in the combustion chamber during the combustion process. Accordingly, this structure makes it possible to improve the ignitability of the fuel mixture gas even if a back flow of the fuel mixture gas temporarily occurs in the combustion chamber during the combustion process.

Further, even if the ground electrode 14 is reversely arranged in the spark plug 10 in a combustion chamber of an internal combustion engine, it is possible to improve the ignitability of the fuel mixture gas similar to the structure in which the ground electrode 14 is correctly arranged to the flow direction of the fuel mixture gas.

Still further, it is possible to form the base part 14*m* of the ground electrode 14 symmetry from the central electrode 13 at the upstream side and the downstream side in the flow direction of the fuel mixture gas. This structure makes it possible to increase the productivity of the spark plug 10.

In a direction perpendicular to the central axis of the central electrode 13, parallel with the virtual plane P, the width W of the base part 14*m* of the ground electrode 14 satisfies the relationship of $2.3\ \text{mm} \leq W \leq 2.9\ \text{mm}$. The experiment according to the exemplary embodiment found that this structure makes it possible to further improve the ignitability of the fuel mixture gas.

In the structure of the spark plug 10 according to the exemplary embodiment, the noble metal chip 16 is formed on the surface of the facing surface 25 of the ground electrode 14, which faces the distal end surface 15*a* of the noble metal chip 15 of the central electrode 13.

Because an electric field is concentrated at the noble metal chip 16, this makes it possible to easily generate the discharge spark between the central electrode 13 and the ground electrode 14, and to suppress consumption of the ground electrode from being promoted by the discharge spark.

The concept of the present disclosure is not limited by the exemplary embodiment previously described. It is possible for the spark plug 10 according to the exemplary embodiment to have various modifications.

A description will be given of the modifications of the spark plug according to the exemplary embodiment with reference to FIG. 12 to FIG. 15.

FIG. 12 to FIG. 15 are views, each showing a schematic structure of the ground electrode in the spark plug according to a modification of the exemplary embodiment of the present disclosure.

Figure 12:
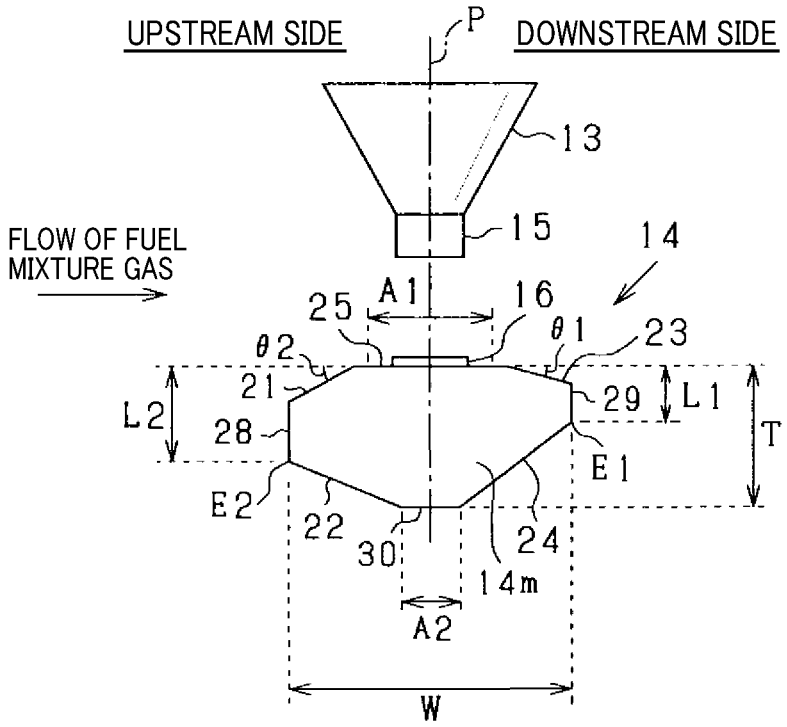
FIG. 12 to FIG. 15 are views, each showing a schematic structure of the ground electrode in the spark plug according to a modification of the exemplary embodiment of the present disclosure.

In the structure of the spark plug shown in FIG. 12 according to the first modification, the ground electrode 14 is arranged not to have plane symmetry with respect to the virtual plane P, and the distance L1 and the distance L2 have a different value, and the angle θ1 and the angle θ2 have a different value. Because the spark plug according to the first modification shown in FIG. 12 has the first slope surface 23, the downstream-side end surface 29, the second slope surface 24, the opposing surface 30, the third slope surface 21, the upstream-side end surface 28, and the fourth slope surface 22, this structure makes it possible to have the same behavior and effects provided by the first slope surface 23, the downstream-side end surface 29, the second slope surface 24, the opposing surface 30, the third slope surface 21, the upstream-side end surface 28 and the fourth slope surface 22.

Figure 13:
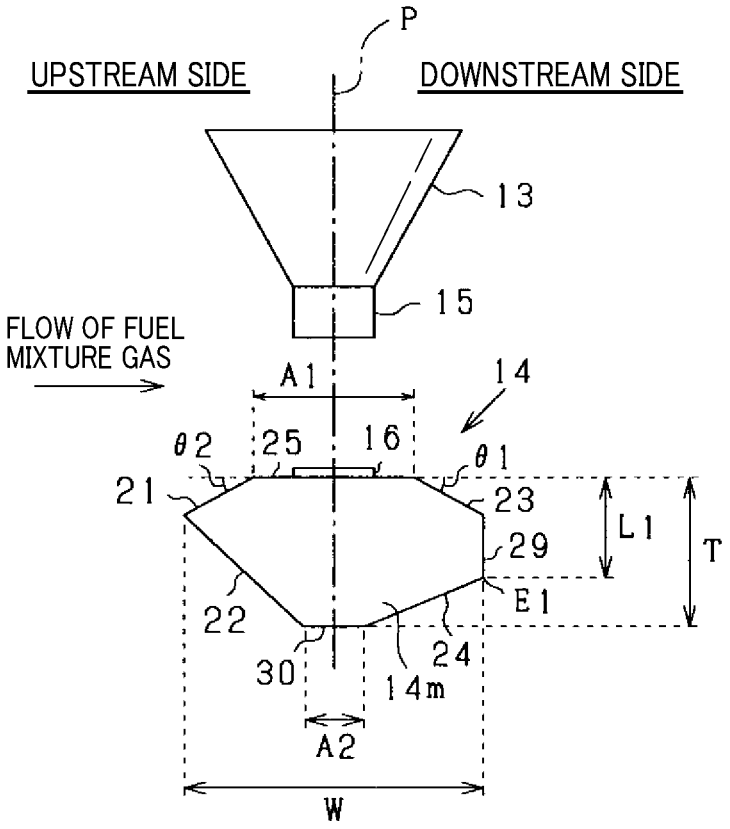

In the structure of the spark plug shown in FIG. 13 according to the second modification, the upstream-side end surface 18 is not formed on the base part 14*m* of the ground electrode 14. Because the spark plug according to the second modification shown in FIG. 13 has the first slope surface 23, the downstream-side end surface 29, the second slope surface 24, the opposing surface 30, the third slope surface 21 and the fourth slope surface 22, this structure makes it possible to have the same behavior and effects provided by the first slope surface 23, the downstream-side end surface 29, the second slope surface 24, the opposing surface 30, the third slope surface 21 and the fourth slope surface 22.

Figure 14:
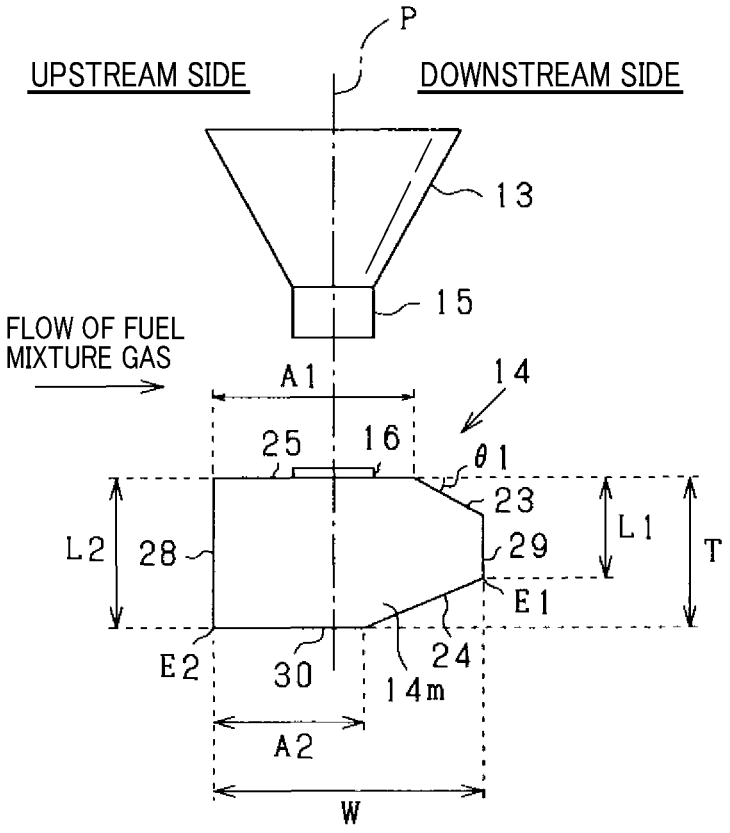

In the structure of the spark plug shown in FIG. 14 according to the third modification, the third slope surface 21 and the fourth slope surface 22 do not formed on the base part 14*m* of the ground electrode 14. Because the spark plug according to the third modification shown in FIG. 14 has the first slope surface 23, the downstream-side end surface 29, the second slope surface 24, the opposing surface 30 and the upstream-side end surface 28, this structure makes it possible to have the same behavior and effects provided by the first slope surface 23, the downstream-side end surface 29, the second slope surface 24, the opposing surface 30 and the upstream-side end surface 28.

Figure 15:
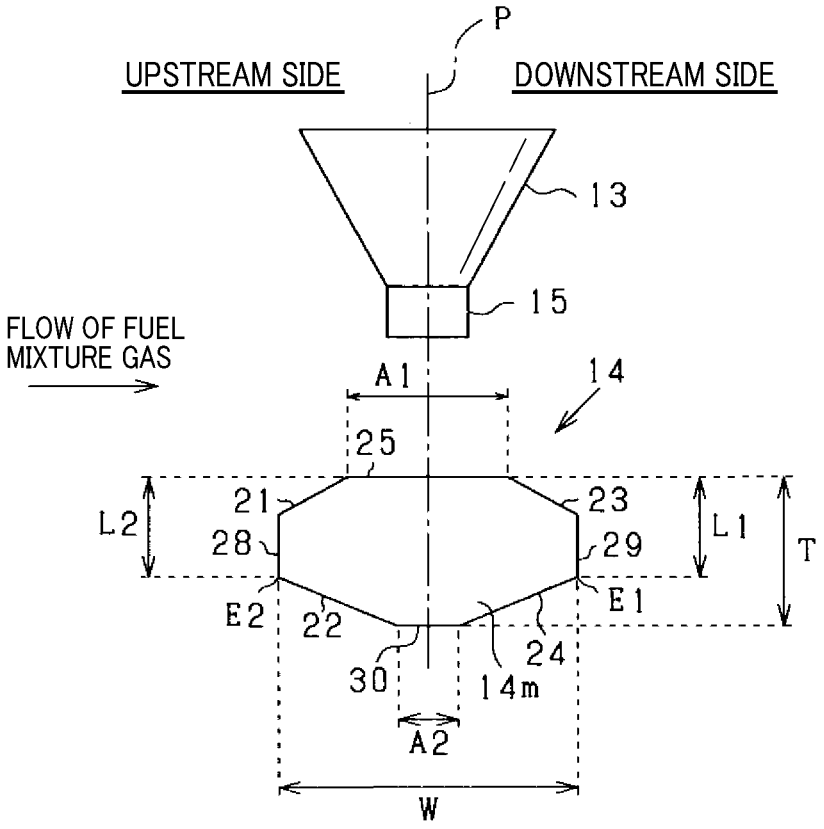

In the structure of the spark plug shown in FIG. 15 according to the fourth modification, the ground electrode 14 does not have the noble metal chip 16. This structure makes it possible to have the same behavior and effects of the spark plug 10 according to the exemplary embodiment.

As previously described in detail, the present disclosure provides the following aspects.

In the structure of the spark plug according to a first aspect of the present disclosure, the ground electrode has a curved shape which is bent in the main part. A fuel mixture gas flows along the flat part of the base part from the side of the ground electrode to the central electrode and another side of the ground electrode. A discharge spark occurs in the spark gap between the central electrode and the ground electrode. This ignites the fuel mixture gas.

The facing surface is formed on the base part of the ground electrode at the position on the base part facing the distal end surface of the central electrode to have a shortest gap between the facing surface and the distal end surface of the central electrode. This structure makes it possible to suppress the flow direction of the fuel mixture gas passing through the spark gap from undergoing turbulence. This structure of the spark plug makes it possible to further suppress the discharge spark from being unstable.

In addition, the first slope surface is formed on the base part at the downstream side in the flow direction of the fuel mixture gas to face the distal end surface of the noble metal chip of the central electrode. The first slope surface is formed adjacent to and connected to the facing surface of the ground electrode, and located downstream in the flow direction of the fuel mixture gas from the noble metal chip.

This structure makes it possible to guide the fuel mixture gas, passed through the spark gap between the central electrode and the ground electrode, into the central area in the combustion chamber. As a result, this makes it possible to reduce the cooling loss of the generated discharge spark, and to improve the ignitability of the fuel mixture gas by the spark plug.

When the ground electrode has a noble metal chip thereon, the base part and the noble metal chip form the ground electrode. When including no noble metal chip, the base part is the ground electrode overall.

The downstream-side end surface is formed at the most downstream side in the flow direction of the fuel mixture gas and parallel with the virtual plane P, in the base part of the ground electrode. The second slope surface is formed on the lower surface of the base part of the ground electrode. The second slope surface is formed at the downstream side in the flow direction of the fuel mixture gas, and faces away from the distal end surface of the central electrode. The second slope surface is formed to be connected to the downstream-side end surface. The opposing surface is formed on the lower surface of the base part of the ground electrode and furthest away from the distal end surface of the central electrode.

The formation of the first slope surface and the opposing surface allows the fuel mixture gas to flow from the downstream-side end surface and the second slope surface. This generates a negative pressure at the downstream side of the downstream-side end surface and the second slope surface.

Accordingly, the fuel mixture gas and the discharge spark generated between the central electrode and the ground electrode are guided, by the generated negative pressure, away from the central electrode, away from the central electrode. This makes it possible to extend the discharge spark from the central electrode toward the direction more away from the central electrode, and improve the ignitability of the fuel mixture gas.

Still further, because the discharge spark start point moves along the first slope surface from the upstream side to the downstream side of the fuel mixture gas, this makes it possible to extend the distance between the discharge spark start point and the central electrode, and to prevent a short circuit from being generated in the middle area of the discharge spark.

The spark plug has the structure in which a width of the facing surface formed on the upper surface of the ground electrode is wider than a width of the opposing surface formed on the lower surface of the base part of the ground electrode. A first angle $\theta 1$ of the facing surface to the first slope surface of the ground electrode satisfies the relationship of $10° \leq \theta 1 \leq 40°$. When a first distance measured in the central axis of the central electrode from the facing surface of the ground electrode to the connection point between the second slope surface and the downstream-side end surface satisfies the relationship of $0.3\ \text{mm} \leq L1 \leq 0.9\ \text{mm}$, this structure makes it possible to improve the ignitability of the fuel mixture gas. The experiment according to the exemplary embodiment of the present disclosure found that the improved structure of the spark plug makes it possible to increase the ignitability of the fuel mixture gas in a combustion chamber of an internal combustion engine.

Further, in the structure of the spark plug, the first slope surface and the second slope surface are connected together through the downstream-side end surface, parallel with the virtual plane, which is the most downstream side plane surface in the flow direction of the fuel mixture gas.

This structure makes it possible to increase the angle between the first slope surface and the downstream-side end surface, and to increase the angle between the downstream-side end surface and the second slope surface larger than the angle between the first slope surface and the second slope surface in a case when the first slope surface and the second slope surface are directly connected together. This structure makes it possible to suppress a sharp part from being generated on the ground electrode, and to increase the productivity of the spark plug.

In accordance with the second aspect of the present disclosure, the spark plug has the structure in which the first angle θ1 satisfies a relationship of 15°≤θ1≤25°, and the first distance L1 satisfies a relationship of 0.5 mm≤L1≤0.7 mm.

In the structure of the spark plug, because the first angle θ1 satisfies the relationship of 15°≤θ1≤25°, it is possible to increase the angle between the first slope surface and the downstream-side end surface on the base part of the ground electrode. This structure further increases the productivity of the spark plug. Further, because the first distance L1 satisfies the relationship of 0.5 mm≤L1≤0.7 mm, it is possible to further improve the ignitability of the fuel mixture gas.

In accordance with the third aspect of the present disclosure, the first angle θ1 satisfies a relationship of 25°≤θ1≤40°, and the first distance L1 satisfies a relationship of 0.5 mm≤L1≤0.8 mm.

In the structure of the spark plug, because the base part of the ground electrode satisfies the relationship of 25°≤θ1≤40° and the relationship of 0.5≤L1≤0.8 mm, it is possible to further improve the ignitability of the fuel mixture gas.

In accordance with the fourth aspect of the present disclosure, the base part of the ground electrode further has a third slope surface, an upstream-side end surface and a fourth slope surface. The third slope surface is formed on the upper surface of the base part and connected to the facing surface, approaching the distal end surface of the central electrode in the flow direction of the fuel mixture gas. The upstream-side end surface is formed to be connected to the third slope surface, at the most upstream side in the flow direction of the fuel mixture gas, and parallel with the virtual plane. *The fourth slope surface is formed on the lower surface of the base part and connected to the upstream-side end surface and the opposing surface, and increasingly away from the distal end surface of the central electrode in the flow direction of the fuel mixture gas. In the spark plug, a second angle θ2 of the facing surface to the third slope surface satisfies a relationship of 10°≤θ2≤40°, and a second distance L2 satisfies a relationship of 0.3 mm≤L2**≤0.9 mm. The second distance is measured, in the central axis of the central electrode to which the central electrode is disposed into the metal shell, from a second connection point between the upstream-side end surface and the fourth slope surface to the facing surface of the base part.

In the structure of the spark plug, the third slope surface is formed to face the distal end surface of the central electrode, on the upper surface of the base part. The third slope surface is formed at the upstream side of the central electrode and connected to the facing surface while closing to the distal end surface of the central electrode 13 from the upstream side toward the downstream side in the flow direction of the fuel mixture gas. The facing surface is formed on the base part of the ground electrode at the position facing the distal end surface of the central electrode. A second distance between the distal end surface of the central electrode and the facing surface has the shortest gap. The formation of the third slope surface makes it possible to regulate the fuel mixture gas flowing into the spark gap between the central electrode and the ground electrode. This structure makes it possible to stably extend the discharge spark.

The upstream-side end surface is formed at the most upstream side in the flow direction of the fuel mixture gas and parallel with the virtual plane P in the base part of the ground electrode. The upstream-side end surface is connected to the third slope surface. The fourth slope surface is formed on the lower surface of the base part of the ground electrode. The fourth slope surface is formed connected to the upstream-side end surface and the opposing surface, and is away from the upstream side toward the downstream side in the flow direction of the fuel mixture gas at the opposite of the distal end surface of the central electrode.

After the fuel mixture gas hits the fourth slope surface, the fuel mixture gas is guided away from the ground electrode along the fourth slope surface. This generates a negative pressure at the downstream side of the second slope surface and the downstream-side end surface of the ground electrode. The discharge spark and the fuel mixture gas passed through the spark gap between the central electrode and the ground electrode are extended toward the direction away from the central electrode. This makes it possible to extend the discharge spark toward the direction away from the central electrode, and to improve the ignitability of the fuel mixture gas.

A second angle θ2 represents the angle of the facing surface to the third slope surface of the ground electrode. The second angle θ2 satisfies the relationship of 10°≤θ2≤40°. A second distance L2 represents the distance measured in the direction along the central axis of the central electrode from the connection point between the fourth slope surface and the upstream-side end surface to the facing surface of the ground electrode. The second distance L2 satisfies the relationship of 0.3 mm≤L2≤0.9 mm. The experiment according to the exemplary embodiment of the present disclosure found that this structure makes it possible to improve the ignitability of the fuel mixture gas. Accordingly, the spark plug having the structure previously described makes it possible to increase the ignitability of the fuel mixture gas.

Further, the third slope surface and the fourth slope surface are connected through the upstream-side end surface which is arranged, parallel with the virtual plane, at the most upstream side in the flow direction of the fuel mixture gas. When the third slope surface and the fourth slope surface are connected together through the upstream-side end surface which is the most upper side plane surface in the flow direction of the fuel mixture gas parallel, it is possible to increase the angle between the third slope surface and the upstream-side end surface and to increase the angle between the upstream-side end surface and the fourth slope surface larger than the angle between the third slope surface and the fourth slope surface in a case when the first slope surface and the second slope surface are directly connected together. This structure makes it possible to suppress a sharp part from being generated on the ground electrode, and to increase the productivity of the spark plug.

In accordance with the fifth aspect of the present disclosure the second angle θ2 satisfies a relationship of 15°≤θ2≤25°, and the second distance L2 satisfies a relationship of 0.5 mm≤L2≤0.7 mm.

In the structure of the spark plug, because the second angle θ2 satisfies the relationship of 15°≤θ2≤25°, this makes it possible to further increase the angle between the third slope surface and the upstream-side end surface. This makes it possible to further increase the productivity of the spark plug.

In accordance with the sixth aspect of the present disclosure, the second angle θ2 satisfies a relationship of 25°≤θ2≤40°, and the second distance L2 satisfies a relationship of 0.5 mm≤L2≤0.8 mm.

In accordance with the seventh aspect of the present disclosure, the spark plug has a structure in which the first angle θ1 is equal to the second angle θ2.

In general, when a spark plug is mounted on a combustion chamber of an internal combustion engine, a backflow of a fuel mixture gas temporarily may occur in the combustion chamber, against the formal flow of the fuel mixture gas.

The spark plug according to the seventh aspect of the present disclosure has the ground electrode 14 which is formed having plane symmetry with respect to the virtual plane. That is, the spark plug has the improved structure in which the first distance L1 and the second distance L2 have the same length, and the first angle θ1 and the second angle θ2 have the same angle. In this improved structure, the first slope surface performs the function of the third slope surface, and the second slope surface performs the function of the fourth slope surface even if a back flow of the fuel mixture gas temporarily occurs in the combustion chamber during the combustion process. This structure makes it possible to improve the ignitability of the fuel mixture gas even if a back flow of the fuel mixture gas temporarily occurs in the combustion chamber during the combustion process.

Further, even if the ground electrode is reversely arranged in the spark plug in a combustion chamber of an internal combustion engine, it is possible to improve the ignitability of the fuel mixture gas similar to the structure in which the ground electrode is correctly arranged to the flow direction of the fuel mixture gas. Further, it is possible to form the base part of the ground electrode symmetry from the central electrode at the upstream side and the downstream side in the flow direction of the fuel mixture gas. This structure makes it possible to increase the productivity of the spark plug.

In accordance with the eight aspect of the present disclosure, a width W of the base part of the ground electrode, measured in a direction which is perpendicular to the virtual plane, satisfies a relationship of 2.3 mm≤W≤2.9 mm.

In a direction perpendicular to the central axis of the central electrode, parallel with the virtual plane, the width W of the base part of the ground electrode satisfies the relationship of 2.3 mm≤W≤2.9 mm. The experiment according to the present disclosure found that this structure makes it possible to further improve the ignitability of the fuel mixture gas.

In accordance with the ninth aspect of the present disclosure, the width W of the base part preferably satisfies a relationship of 2.5 mm≤W≤2.7 mm.

In accordance with a tenth aspect of the present disclosure, the spark plug further has a first noble metal chip formed on the facing surface of the base part, to face the distal end surface of the central electrode.

Because an electric field is concentrated at the noble metal chip, this makes it possible to easily generate the discharge spark between the central electrode and the ground electrode, and to suppress electric consumption of the ground electrode from being promoted by discharge spark.

While specific embodiments of the present disclosure have been described in detail, it will be appreciated by those skilled in the art that various modifications and alternatives to those details could be developed in light of the overall teachings of the disclosure. Accordingly, the particular arrangements disclosed are meant to be illustrative only and not limited to the scope of the present disclosure which is to be given the full breadth of the following claims and all equivalents thereof.

What is claimed is:

1. A spark plug comprising a metal shell having a cylindrical shape, a center electrode disposed in an inside of the metal shell and a ground electrode connected to the metal shell, and having a curved shape arranged facing a distal end surface of the central electrode, a virtual plane along the curved shape of the ground electrode facing a flow of a fuel mixture gas, the ground electrode comprising a base part, wherein the base part of the ground electrode comprises:

a facing surface formed on an upper surface of the base part at a position facing the distal end surface of the central electrode to form a spark gap between the facing surface and the distal end surface of the central electrode;

a first slope surface formed on the upper surface of the base part and connected to the facing surface, and increasingly away from the distal end surface of the central electrode in a flow direction of the fuel mixture gas, a downstream-side end surface formed at a most downstream side in the flow direction of the fuel mixture gas and parallel with the virtual plane, and connected to the first slope surface;

a second slope surface formed on a lower surface of the base part and connected to the downstream-side end surface, and approaching the distal end surface of the central electrode in the flow direction of the fuel mixture gas; and an opposing surface formed on the lower surface of the base part, and farthest away from the distal end surface of the central electrode, wherein a width A1 of the facing surface of the base part is wider than a width A2 of the opposing surface of the base part, a first angle θ1 of the facing surface to the first slope surface satisfies a relationship of 10°≤θ1≤40°, and a first distance L1 satisfies a relationship of 0.3 mm≤L1≤0.9 mm, where the first distance is measured, in the central axis of the central electrode to which the central electrode is disposed into the metal shell, from a connection point between the second slope surface and the downstream-side end surface to the facing surface of the base part.

2. The spark plug according to claim 1, wherein in the base part of the ground electrode, the first angle θ1 satisfies a relationship of 15°≤θ1≤25°, and the first distance L1 satisfies a relationship of 0.5 mm≤L1≤0.7 mm.

3. The spark plug according to claim 1, wherein in the base part of the ground electrode, the first angle θ1 satisfies a relationship of 25°≤θ1≤40°, and the first distance L1 satisfies a relationship of 0.5 mm≤L1≤0.8 mm.

4. The spark plug according to claim 1, wherein the base part of the ground electrode further comprises:

a third slope surface formed on the upper surface of the base part and connected to the facing surface, approaching the distal end surface of the central electrode in the flow direction of the fuel mixture gas;

an upstream-side end surface formed connected to the third slope surface, at a most upstream side in the flow direction of the fuel mixture gas, and formed parallel with the virtual plane; and a fourth slope surface formed on the lower surface of the base part and connected to the upstream-side end surface and the opposing surface, and increasingly away from the distal end surface of the central electrode in the flow direction of the fuel mixture gas, wherein a second angle θ2 of the facing surface to the third slope surface satisfies a relationship of 10°≤θ2≤40°, and a second distance L2 satisfies a relationship of 0.3 mm≤L2≤0.9 mm, where the second distance is measured, in the central axis of the central electrode to which the central electrode is disposed into the metal shell, from a second connection point between the upstream-side end surface and the fourth slope surface to the facing surface of the base part.

5. The spark plug according to claim 4, wherein in the base part of the ground electrode, the second angle θ2 satisfies a relationship of 15°≤θ2≤25°, and the second distance L2 satisfies a relationship of 0.5 mm≤L2≤0.7 mm.

6. The spark plug according to claim 4, wherein in the base part of the ground electrode, the second angle θ2 satisfies a relationship of 25°≤θ2≤40°, and the second distance L2 satisfies a relationship of 0.5 mm≤L2≤0.8 mm.

7. The spark plug according to claim 4, wherein in the base part of the ground electrode, the first angle θ1 is equal to the second angle θ2.

8. The spark plug according to claim 1, wherein in the base part of the ground electrode, a width W of the base part of the ground electrode, measured in a direction which is perpendicular to the virtual plane, satisfies a relationship of 2.3 mm≤W≤2.9 mm.

9. The spark plug according to claim 8, wherein in the base part of the ground electrode, the width W of the base part satisfies a relationship of 2.5 mm≤W≤2.7 mm.

10. The spark plug according to claim 1, further comprising a first noble metal chip formed on the facing surface of the base part, facing the distal end surface of the central electrode.

* * * * *